US009587495B2

(12) United States Patent
Beattie et al.

(10) Patent No.: US 9,587,495 B2
(45) Date of Patent: Mar. 7, 2017

(54) MISTAKE PROOF DAMPER POCKET SEALS

(75) Inventors: Jeffrey S. Beattie, South Glastonbury, CT (US); Jeffrey Michael Jacques, East Hartford, CT (US)

(73) Assignee: UNITED TECHNOLOGIES CORPORATION, Farmington, CT (US)

( * ) Notice: Subject to any disclaimer, the term of this patent is extended or adjusted under 35 U.S.C. 154(b) by 1277 days.

(21) Appl. No.: 13/537,127

(22) Filed: Jun. 29, 2012

(65) Prior Publication Data

US 2014/0003950 A1 Jan. 2, 2014

(51) Int. Cl.
*F01D 5/22* (2006.01)
*F01D 11/00* (2006.01)

(52) U.S. Cl.
CPC ..... *F01D 5/22* (2013.01); *F01D 11/006* (2013.01); *F05D 2230/64* (2013.01); *F05D 2260/30* (2013.01); *Y10T 29/49316* (2015.01)

(58) Field of Classification Search
CPC ..... F01D 11/006; F01D 11/00; F01D 5/22; F01D 5/26
See application file for complete search history.

(56) References Cited

U.S. PATENT DOCUMENTS 4,505,642 A 3/1985 Hill
4,516,910 A 5/1985 Bouiller et al.
4,743,164 A 5/1988 Kalogeros
5,125,487 A * 6/1992 Hodge ..... 192/3.34
5,573,375 A 11/1996 Barcza
5,746,578 A * 5/1998 Brassfield et al. ..... 416/190
5,785,499 A 7/1998 Houston et al.
5,803,710 A * 9/1998 Dietrich et al. ..... 416/248
5,827,047 A 10/1998 Gonsor et al.
5,924,699 A 7/1999 Airey et al.
6,171,058 B1 1/2001 Stec
(Continued)

FOREIGN PATENT DOCUMENTS

WO 2013154657 10/2013

OTHER PUBLICATIONS

International Search Report and Written Opinion for International Application No. PCT/US2013/044252 completed on Sep. 13, 2013.
(Continued)

*Primary Examiner* — John K Fristoe, Jr.
*Assistant Examiner* — Michael Sehn
(74) *Attorney, Agent, or Firm* — Carlson, Gaskey & Olds, P.C.

(57) ABSTRACT

A method of assembling a blade array includes the step of inserting a blade having a platform into a rotor. The blade includes a pocket radially beneath the platform that includes an interference feature. The blade corresponds to one of first and second blades that are scaled versions of one another. The method includes the step of selecting a damper seal, and inserting the damper seal into the pocket. The damper seal corresponds to one of first and second damper seals. The first damper seal cooperates with the interference feature thereby permitting the first damper seal to fully seat within the pocket. The second damper seal is obstructed by the interference feature thereby preventing the second damper seal from fully seating within the pocket.

12 Claims, 3 Drawing Sheets

(56) References Cited

U.S. PATENT DOCUMENTS

| | | | | |
|---|---|---|---|---|
| 6,533,550 | B1 | 3/2003 | Mills | |
| 6,837,686 | B2 | 1/2005 | Di Paola et al. | |
| 6,884,025 | B2 | 4/2005 | Pickens et al. | |
| 7,121,802 | B2 * | 10/2006 | Athans et al. | 416/193 A |
| 7,507,075 | B2 | 3/2009 | Kang et al. | |
| 7,625,174 | B2 | 12/2009 | Drerup et al. | |
| 2006/0056974 | A1 | 3/2006 | Beattie | |
| 2009/0004013 | A1 | 1/2009 | Ramlogan et al. | |
| 2009/0252610 | A1 | 10/2009 | Wassynger et al. | |
| 2009/0252611 | A1 | 10/2009 | Tipton et al. | |
| 2010/0030365 | A1 | 2/2010 | Lilly | |
| 2010/0098547 | A1 | 4/2010 | Hagan et al. | |
| 2010/0111700 | A1 | 5/2010 | Kim et al. | |

OTHER PUBLICATIONS

International Preliminary Report on Patentability for International Application No. PCT/US2013/044252 mailed Jan. 8, 2015.
European Search Report for European Application No. 13810659.6 mailed on Jul. 14, 2015.

* cited by examiner

MISTAKE PROOF DAMPER POCKET SEALS

BACKGROUND

This disclosure relates to damper pocket seals for blades used in a turbine blade array, for example. In particular, the disclosure relates to mistake proofing the installation of the damper pocket seals into the blades.

Damper seals are used to prevent leakage between circumferentially adjacent blade platforms within a stage of a gas turbine engine. The damper seals are arranged in adjacent pockets to block a circumferential gap between the adjacent platforms. Additionally, the damper seals minimize undesired movement between the adjacent blades.

One type of gas turbine engine may include a core that is a scaled version of another gas turbine engine core. The scaled cores provide different thrust, but rely upon generally the same engine design. As a result, the blades between the scaled versions may have a virtually identical shape such that they are indistinguishable from one another without careful measurement. Typically, the blades and damper seals are provided in kits for a given gas turbine engine such that it is difficult to interchange parts between scaled cores during a maintenance or overhaul procedure. Nonetheless, it still may be possible to insert the damper seal from one engine into its scaled counterpart engine. If such a mistake occurs, the damper seal may fall out during engine operation.

SUMMARY

In one exemplary embodiment, a method of assembling a blade array includes the step of inserting a blade having a platform into a rotor. The blade includes a pocket radially beneath the platform that includes an interference feature. The blade corresponds to one of first and second blades that are scaled versions of one another. The method includes the step of selecting a damper seal, and inserting the damper seal into the pocket. The damper seal corresponds to one of first and second damper seals. The first damper seal cooperates with the interference feature thereby permitting the first damper seal to fully seat within the pocket. The second damper seal is obstructed by the interference feature thereby preventing the second damper seal from fully seating within the pocket.

In a further embodiment of any of the above, the first and second blades each include an airfoil and a root that are substantially the same shape as one another.

In a further embodiment of any of the above, the first and second blades each include a platform that are substantially the same, excluding the interference feature.

In a further embodiment of any of the above, the first blade has a scale factor of 1.1 or less compared to the second blade.

In a further embodiment of any of the above, the first blade has a scale factor of about 1.04 compared to the second blade.

In a further embodiment of any of the above, the first and second blades are configured to be used for the same stage of different gas turbine engines that have scaled cores relative to one another.

In a further embodiment of any of the above, the first and second blades are turbine blades.

In a further embodiment of any of the above, the method includes the step of inserting another blade into the rotor adjacent to the other blade. The damper seal is inserted into adjacent pockets of the adjacent blades to seal a circumferential gap between adjacent platforms of the adjacent blades.

In a further embodiment of any of the above, the damper seal includes a generally C-shaped wall having forward and aft ends abutting an inner surface of the pocket.

In a further embodiment of any of the above, the pocket includes an aft side, and the damper seal includes forward and aft ends. The aft side provides the interference feature such that the aft end is obstructed by the aft side of the pocket.

In a further embodiment of any of the above, the wall includes a lateral tab. The interference feature corresponds to a protrusion extending into the pocket. The lateral tab of the second damper seal is obstructed by the protrusion.

In a further embodiment of any of the above, the first damper seal includes a first tab having a first forward edge spaced a first distance from a first forward end. The second damper seal includes a second tab having a second forward edge spaced a second distance from a second forward end. The first and second distances are different than one another.

In a further embodiment of any of the above, the lateral tab extends radially inwardly from the wall.

In a further embodiment of any of the above, the damper seal is a stamped steel, and the blade is a nickel alloy.

In another exemplary embodiment, a blade array includes a rotor, and a blade is supported in the rotor. The blade includes a platform and a pocket arranged radially beneath the platform that includes an interference feature. A correct damper seal is arranged in the pocket and cooperates with the interference feature thereby permitting the correct damper seal to fully seat within the pocket. The interference feature is configured to obstruct an incorrect damper seal thereby preventing the incorrect damper seal from fully seating within the pocket.

In a further embodiment of any of the above, the correct and incorrect damper seals include a generally C-shaped wall having forward and aft ends abutting an inner surface of the pocket.

In a further embodiment of any of the above, the pocket includes an aft side, and the correct and incorrect damper seal include forward and aft ends. The aft side provides the interference feature such that the aft end of the incorrect damper seal is obstructed by the aft side of the pocket.

In a further embodiment of any of the above, the wall of each correct and incorrect damper seal includes a lateral tab. The interference feature corresponds to a protrusion extending into the pocket, and the lateral tab of the incorrect damper seal is obstructed by the protrusion.

In a further embodiment of any of the above, the correct damper seal includes a first tab having a first forward edge spaced a first distance from a first forward end. The incorrect damper seal includes a second tab having a second forward edge spaced a second distance from a second forward end, and the first and second distances different than one another.

In a further embodiment of any of the above, the lateral tab extends radially inwardly from the wall.

BRIEF DESCRIPTION OF THE DRAWINGS

The disclosure can be further understood by reference to the following detailed description when considered in connection with the accompanying drawings wherein.

DETAILED DESCRIPTION

Figure 1:
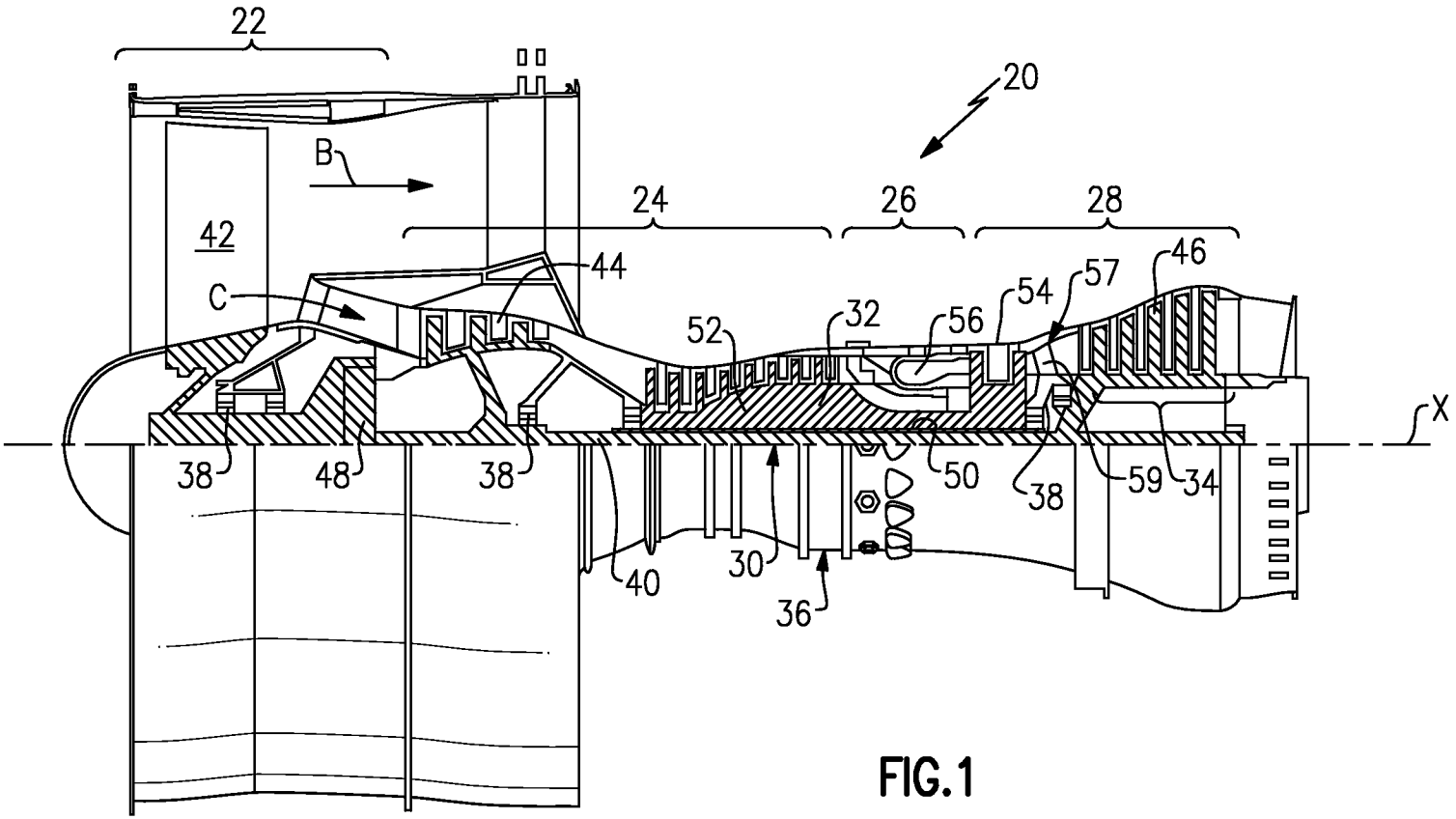
FIG. 1 schematically illustrates a gas turbine engine embodiment.

FIG. 1 schematically illustrates an example gas turbine engine 20 that includes a fan section 22, a compressor section 24, a combustor section 26 and a turbine section 28. Alternative engines might include an augmenter section (not shown) among other systems or features. The fan section 22 drives air along a bypass flow path B while the compressor section 24 draws air in along a core flow path C where air is compressed and communicated to a combustor section 26. In the combustor section 26, air is mixed with fuel and ignited to generate a high pressure exhaust gas stream that expands through the turbine section 28 where energy is extracted and utilized to drive the fan section 22 and the compressor section 24.

Although the disclosed non-limiting embodiment depicts a turbofan gas turbine engine, it should be understood that the concepts described herein are not limited to use with turbofans as the teachings may be applied to other types of turbine engines; for example a turbine engine including a three-spool architecture in which three spools concentrically rotate about a common axis and where a low spool enables a low pressure turbine to drive a fan via a gearbox, an intermediate spool that enables an intermediate pressure turbine to drive a first compressor of the compressor section, and a high spool that enables a high pressure turbine to drive a high pressure compressor of the compressor section.

The example engine 20 generally includes a low speed spool 30 and a high speed spool 32 mounted for rotation about an engine central longitudinal axis A relative to an engine static structure 36 via several bearing systems 38. It should be understood that various bearing systems 38 at various locations may alternatively or additionally be provided.

The low speed spool 30 generally includes an inner shaft 40 that connects a fan 42 and a low pressure (or first) compressor section 44 to a low pressure (or first) turbine section 46. The inner shaft 40 drives the fan 42 through a speed change device, such as a geared architecture 48, to drive the fan 42 at a lower speed than the low speed spool 30. The high-speed spool 32 includes an outer shaft 50 that interconnects a high pressure (or second) compressor section 52 and a high pressure (or second) turbine section 54. The inner shaft 40 and the outer shaft 50 are concentric and rotate via the bearing systems 38 about the engine central longitudinal axis X.

A combustor 56 is arranged between the high pressure compressor 52 and the high pressure turbine 54. In one example, the high pressure turbine 54 includes at least two stages to provide a double stage high pressure turbine 54. In another example, the high pressure turbine 54 includes only a single stage. As used herein, a "high pressure" compressor or turbine experiences a higher pressure than a corresponding "low pressure" compressor or turbine.

The example low pressure turbine 46 has a pressure ratio that is greater than about 5. The pressure ratio of the example low pressure turbine 46 is measured prior to an inlet of the low pressure turbine 46 as related to the pressure measured at the outlet of the low pressure turbine 46 prior to an exhaust nozzle.

A mid-turbine frame 57 of the engine static structure 36 is arranged generally between the high pressure turbine 54 and the low pressure turbine 46. The mid-turbine frame 57 further supports bearing systems 38 in the turbine section 28 as well as setting airflow entering the low pressure turbine 46.

The core airflow C is compressed by the low pressure compressor 44 then by the high pressure compressor 52 mixed with fuel and ignited in the combustor 56 to produce high speed exhaust gases that are then expanded through the high pressure turbine 54 and low pressure turbine 46. The mid-turbine frame 57 includes vanes 59, which are in the core airflow path and function as an inlet guide vane for the low pressure turbine 46. Utilizing the vane 59 of the mid-turbine frame 57 as the inlet guide vane for low pressure turbine 46 decreases the length of the low pressure turbine 46 without increasing the axial length of the mid-turbine frame 57. Reducing or eliminating the number of vanes in the low pressure turbine 46 shortens the axial length of the turbine section 28. Thus, the compactness of the gas turbine engine 20 is increased and a higher power density may be achieved.

The disclosed gas turbine engine 20 in one example is a high-bypass geared aircraft engine. In a further example, the gas turbine engine 20 includes a bypass ratio greater than about six (6), with an example embodiment being greater than about ten (10). The example geared architecture 48 is an epicyclical gear train, such as a planetary gear system, star gear system or other known gear system, with a gear reduction ratio of greater than about 2.3.

In one disclosed embodiment, the gas turbine engine 20 includes a bypass ratio greater than about ten (10:1) and the fan diameter is significantly larger than an outer diameter of the low pressure compressor 44. It should be understood, however, that the above parameters are only exemplary of one embodiment of a gas turbine engine including a geared architecture and that the present disclosure is applicable to other gas turbine engines.

A significant amount of thrust is provided by the bypass flow B due to the high bypass ratio. The fan section 22 of the engine 20 is designed for a particular flight condition—typically cruise at about 0.8 Mach and about 35,000 feet. The flight condition of 0.8 Mach and 35,000 ft., with the engine at its best fuel consumption—also known as "bucket cruise Thrust Specific Fuel Consumption ('TSFC')"—is the industry standard parameter of pound-mass (lbm) of fuel per hour being burned divided by pound-force (lbf) of thrust the engine produces at that minimum point.

"Low fan pressure ratio" is the pressure ratio across the fan blade alone, without a Fan Exit Guide Vane ("FEGV") system. The low fan pressure ratio as disclosed herein according to one non-limiting embodiment is less than about 1.50. In another non-limiting embodiment the low fan pressure ratio is less than about 1.45.

"Low corrected fan tip speed" is the actual fan tip speed in ft/sec divided by an industry standard temperature correction of [(Tram ° R)/518.7)0.5]. The "Low corrected fan tip speed", as disclosed herein according to one non-limiting embodiment, is less than about 1150 ft/second.

The example gas turbine engine includes the fan 42 that comprises in one non-limiting embodiment fewer than about 26 fan blades. In another non-limiting embodiment, the fan section 22 includes less than about 20 fan blades. Moreover, in one disclosed embodiment the low pressure turbine 46 includes no more than about 6 turbine rotors schematically indicated at 34. In another non-limiting example embodiment the low pressure turbine 46 includes about 3 turbine rotors. A ratio between the number of fan blades 42 and the number of low pressure turbine rotors is between about 3.3 and about 8.6. The example low pressure turbine 46 provides the driving power to rotate the fan section 22 and therefore the relationship between the number of turbine rotors 34 in the low pressure turbine 46 and the number of blades 42 in the fan section 22 disclose an example gas turbine engine 20 with increased power transfer efficiency.

Figure 2:
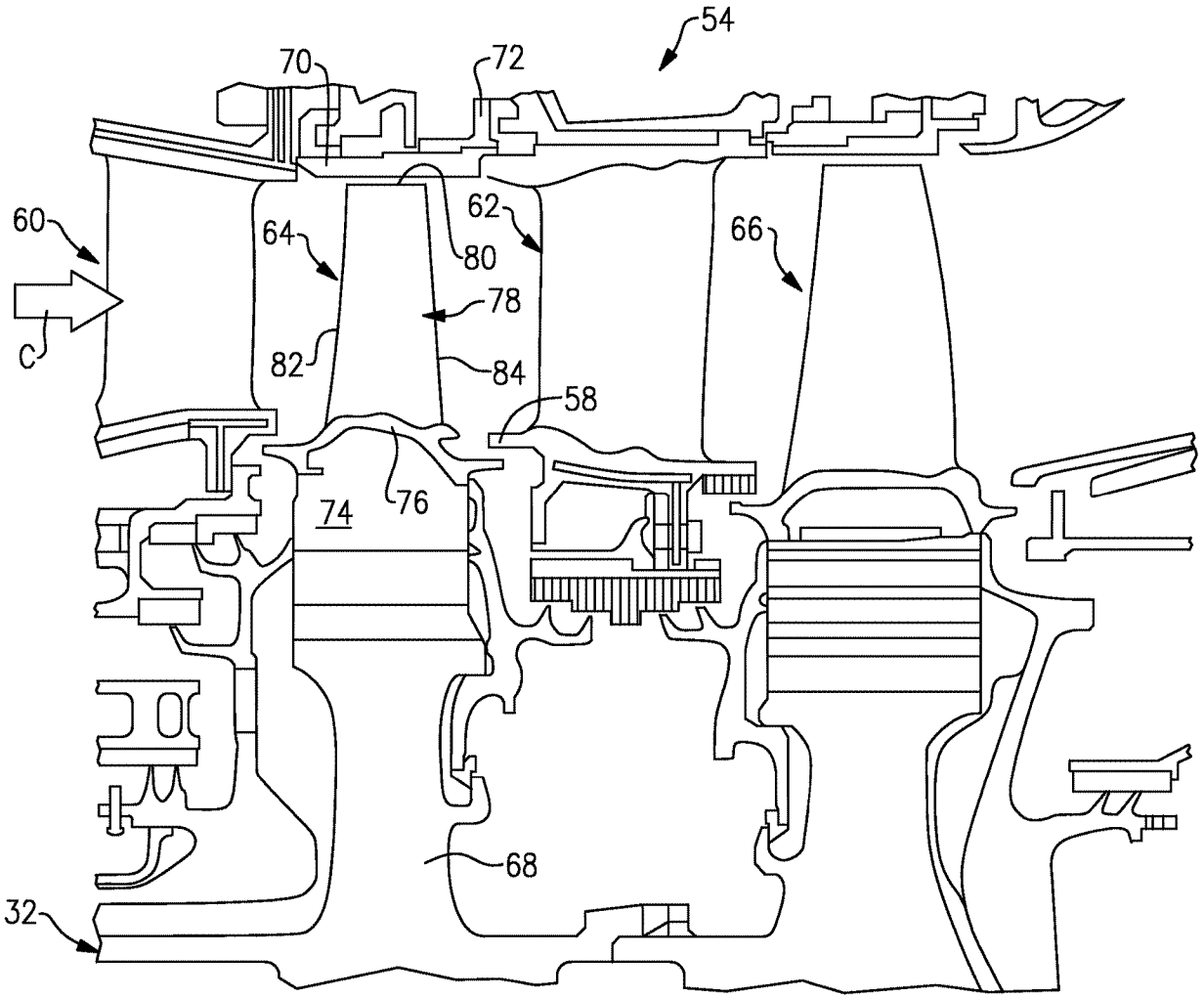
FIG. 2 is a cross-sectional view through a high pressure turbine section.

Referring to FIG. 2, a cross-sectional view through a high pressure turbine section 54 is illustrated. In the example high pressure turbine section 54, first and second fixed vane arrays 60, 62 are axially spaced apart from one another. A first stage array of turbine blades 64 is arranged axially between the first and second fixed vane arrays 60, 62. A second stage array of turbine blades 66 is arranged aft of the second fixed vane array 62. The first and second stage arrays of turbine blades 64, 66, which are constructed from a nickel alloy, are arranged within a core flow path C and connected to a spool 32.

A root 74 of the turbine blade 64 is mounted to the rotor disk 68. The root 74 supports a platform 76 from which an airfoil extends 78. The airfoil 78, which includes leading and trailing edges 82, 84, provides the tip 80 arranged adjacent to a blade outer air seal 70 mounted to a turbine case 72. A platform 58 of the second fixed vane array 62 is arranged in an overlapping relationship with the turbine blades 64, 66.

The engine 20 includes a core section that is a scaled version of another engine core section. That is, two engines of different sizes and thrusts generally share the same design such that the core components from one engine are scaled versions of the other engine core components. A first blade of a first core and a second blade of a second core each include an airfoil and a root that are substantially the same shape as one another, although the blades may have slightly different cooling features. However, the differences in cooling features may not be visible or may be subtle. As a result, the turbine blades for the same stages of the cores have a substantially identical shape or external contour. This makes it difficult to discern one core's components from the other core's components. In one example, the first blade has a scale factor of 1.1 or less compared to the second blade such that there is a 10% or less size difference between the different blades. In another example, the first blade has a scale factor of about 1.04 compared to the second blade such that there is only about a 4% size difference between the different blades.

Figure 3:
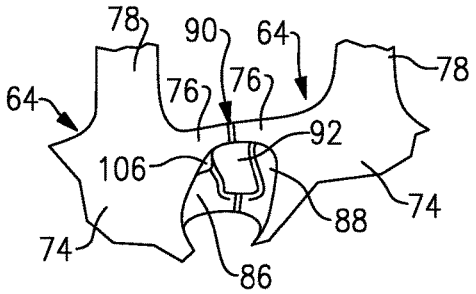
FIG. 3 is a schematic view of adjacent blades having a damper seal installed into adjacent pockets.

During maintenance or overhaul of an engine, a blade array, shown in FIG. 3, is assembled by inserting a blade 64 into a rotor 68 (FIG. 2). Another blade 64 is inserted into the rotor adjacent to the other blade 64 to provide an arrangement shown in FIG. 3. The blades 64 each include laterally spaced pressure and suction side pockets 86, 88 radially beneath the platform 76. A circumferential gap 90 is provided circumferentially between the adjacent platforms 76. A damper seal 92, which may be stamped steel, is inserted into adjacent pockets 86, 88 of the adjacent blades 64 to seal the circumferential gap 90.

Like the scaled blades, the damper seals for the same stage of different cores may look alike and be of substantially the same shape. To prevent the incorrect damper seal from being used with the wrong turbine blades, an interference feature, such as protrusion 106, may be provided in one or both of the pockets 86, 88. The correct damper seal for a given blade cooperates with the interference feature to permit the first damper seal to fully seat within the pocket. The incorrect damper seal is obstructed by the interference feature to prevent the second damper seal from fully seating within the pocket. In this manner, the interference feature ensures that only the correct damper seal can be used for a particular blade, which is shaped substantially the same as a scaled version of that blade.

Figure 4A:
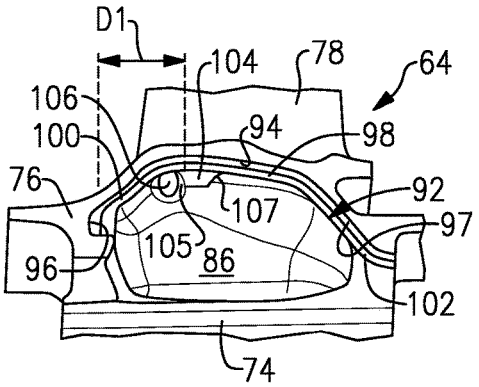
FIG. 4A illustrates a first version of a first stage turbine blade with a correct damper seal.
Figure 4B:
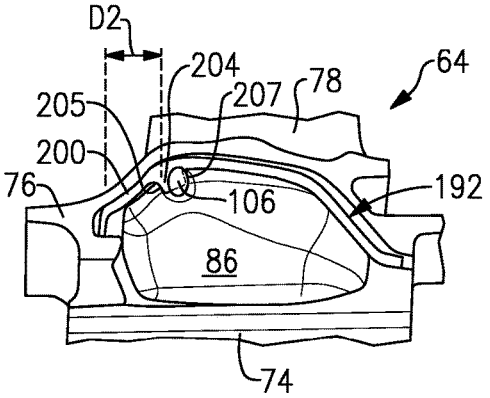
FIG. 4B illustrates the turbine blade of FIG. 4A with an incorrect damper seal.
Figure 4C:
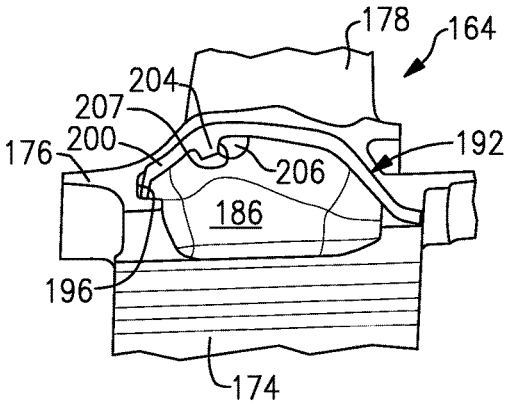
FIG. 4C illustrates a second version of a first stage turbine blade with a correct damper seal.

Referring to FIGS. 4A-4C, the damper seal 92 is correct for the blade 64, and the damper seal 192 is correct for the blade 164. The damper seals 92, 192 includes a generally C-shaped wall 98, 198, respectively. Referring to FIG. 4A, the wall 98 includes a forward end 100 received in a forward recess 96 of the pocket 86. An aft end 102 engages an inner surface 94 of the pocket 86 at an aft side 97. A tab 104 extends laterally and radially inward from the wall 98. The tab 104 includes forward and aft edges 105, 107. The forward edge 105 is spaced a first distance D1 from the forward end 100. The position of the protrusion 106 accommodates the tab 104 to permit the damper seal 92 to fully seat within the pocket 86.

Referring to FIG. 4B, the protrusion 106 prevents installation of the smaller damper seal 192. The tab 204 includes forward and aft edges 205, 207. The forward edge 205 is spaced a second distance D2 from the forward end 200, which is different than the first distance D1. Thus, in this example, the placement of the tab 104, 204 ensures the proper damper seal is used with the proper blade.

Figure 4D:
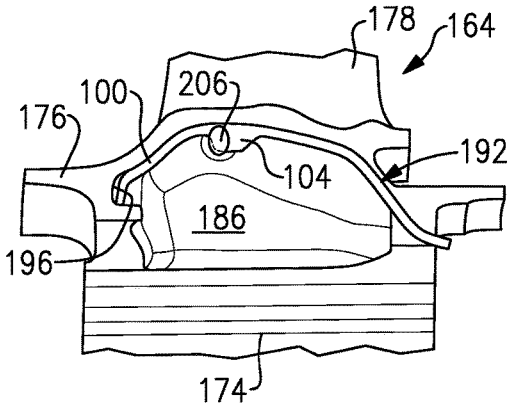
FIG. 4D illustrates the turbine blade of FIG. 4C with an incorrect damper seal.

Referring to FIG. 4C, the blade 164 includes a platform 176 on root 174 that supports an airfoil 178. The forward end 200 of the damper seal 192 is received in the forward recess 196. The aft edge 207 is positioned forward of the protrusion 206, which accommodates the tab 204 to permit the damper seal 192 to fully seat within the pocket 186. As shown in FIG. 4D, the tab 104 is obstructed by the protrusion 206, preventing the damper seal 92 from being fully seated within the pocket 186.

Although example embodiments have been disclosed, a worker of ordinary skill in this art would recognize that certain modifications would come within the scope of the claims. For that reason, the following claims should be studied to determine their true scope and content.

What is claimed is:

1. A method of assembling a blade array comprising the steps of:

inserting a blade having a platform into a rotor, the blade including a pocket radially beneath the platform that includes a protrusion extending from the pocket, the blade corresponding to one of first and second blades that are scaled versions of one another;

selecting a damper seal that includes a generally C-shaped wall having forward and aft ends abutting an inner surface of the pocket, wherein the wall includes a lateral tab; and inserting the damper seal into the pocket, the damper seal corresponding to one of first and second damper seals, wherein the first damper seal cooperates with the protrusion thereby permitting the first damper seal to fully seat within the pocket, and the second damper seal is obstructed by the protrusion thereby preventing the second damper seal from fully seating within the pocket, the lateral tab of the second damper seal being obstructed by the protrusion to prevent installation of the second damper seal into the pocket.

2. The method according to claim 1, wherein the first and second blades each include an airfoil and a root that are substantially the same shape as one another.

3. The method according to claim 2, wherein the first and second blades each include platforms that are substantially the same, excluding the protrusion.

4. The method according to claim 2, wherein the first blade has a scale factor of 1.1 or less compared to the second blade.

5. The method according to claim 4, wherein the first blade has a scale factor of about 1.04 compared to the second blade.

6. The method according to claim 1, wherein the first and second blades are configured to be used for the same stage of different gas turbine engines that have scaled cores relative to one another.

7. The method according to claim 6, wherein the first and second blades are turbine blades.

8. The method according to claim 1, comprising the step of inserting another blade into the rotor adjacent to the other blade, the damper seal inserted into adjacent pockets of the adjacent blades to seal a circumferential gap between adjacent platforms of the adjacent blades.

9. The method according to claim 1, wherein the pocket includes an aft side, and the damper seal includes forward and aft ends, wherein the aft side provides the protrusion such that the aft end is obstructed by the aft side of the pocket.

10. The method according to claim 1, wherein the first damper seal includes a first tab having a first forward edge spaced a first distance from a first forward end, and the second damper seal includes a second tab having a second forward edge spaced a second distance from a second forward end, the first and second distances different than one another.

11. The method according to claim 1, wherein the lateral tab extends radially inwardly from the wall.

12. The method according to claim 1, wherein the damper seal is a stamped steel, and the blade is a nickel alloy.

* * * * *